United States Patent [19]

Nagamoto et al.

[11] 4,351,999

[45] Sep. 28, 1982

[54] HEATING APPARATUS PROVIDED WITH A VOICE SYNTHESIZING CIRCUIT

[75] Inventors: Shunichi Nagamoto; Masao Ito, both of Nara; Tatsuo Saka, Ikoma; Tetsu Kobayashi, Nara, all of Japan

[73] Assignee: Matsushita Electric Industrial Co., Ltd., Kadoma, Japan

[21] Appl. No.: 220,234

[22] Filed: Dec. 23, 1980

[30] Foreign Application Priority Data

Dec. 26, 1979 [JP] Japan ..... 54-172044
May 26, 1980 [JP] Japan ..... 55-70435

[51] Int. Cl.[3] ..... H05B 6/68

[52] U.S. Cl. ..... 219/10.55 B; 219/10.55 R; 340/384 E; 340/692

[58] Field of Search ..... 219/10.55 B, 10.55 R, 219/10.55 M, 490, 492, 494, 501, 506, 508, 497; 307/117; 340/692, 602, 569, 540, 500, 384 E

[56] References Cited

U.S. PATENT DOCUMENTS

| | | | |
|---|---|---|---|
| 4,158,432 | 6/1979 | van Bavel | 219/10.55 B X |
| 4,158,759 | 6/1979 | Mason | 219/506 X |
| 4,162,381 | 7/1979 | Buck | 219/10.55 B |
| 4,230,731 | 10/1980 | Tyler | 219/10.55 B X |
| 4,250,370 | 2/1981 | Sasaki et al. | 219/10.55 B |

FOREIGN PATENT DOCUMENTS

| | | | |
|---|---|---|---|
| 54-2098 | 9/1979 | Japan | 219/10.55 B |

*Primary Examiner*—Arthur T. Grimley
*Attorney, Agent, or Firm*—Cushman, Darby & Cushman

[57] ABSTRACT

A microcomputer-controlled microwave oven including key switch inputs and voice synthesizer for conveying information to a user. The synthesizer is used in connection with a data input program to aid the user in inputting data via the key switches to avert errors in inputting data that may result in over-heating of food or a fire inside the oven's heating chamber.

14 Claims, 9 Drawing Figures

HEATING APPARATUS PROVIDED WITH A VOICE SYNTHESIZING CIRCUIT

BACKGROUND OF THE INVENTION

1. Field of the Invention

The present invention relates to a heating apparatus such as a microwave oven, more particularly to a heating apparatus which is provided with a speech synthesizer and a microcomputer.

2. Prior Arts

Recently, on the market there have become available microwave ovens which are provided with a microcomputer and which can be actuated to select the most suitable heating sequence among several pre-programmed to memorized heating sequence programs during their heating operations. Generally speaking, in operating such microwave ovens the user can input data such as heating temperature, heating power output, heating time, etc. for storing heating sequence programs into memory devices by pushing several operation buttons with a predetermined order. By combining such button-pushing operations in complex ways, the user can put in comparatively complicated sequence programs in the heating operations. It is naturally advantageous that by use of much complex heating sequence programs, a wide variety of cooking methods can be employed by the users. However, there arise shortcomings that the user becomes bothered with complicated key operations and that she or he can not utilize full advantages of the heating apparatus equipped with the microcomputer.

In particular, it is necessary to confirm whether the user's key operation is correct by the displayed contents corresponding to the key input data, and therefore it takes much time to set the heating apparatus to the desired sequence program states. There is a high probability that the user erroneously inputs the sequence program data. This erroneous setting in the heating apparatus such as microwave ovens sometimes causes over-heating of the foods placed in the heating chamber, i.e. fatal cooking failure on the user side. In worst cases, such over-heating may cause burning of the user's hands and may set fire in the heating chamber. It is desirable to improve the conventional heating apparatuses in these aspects.

Semiconductor technology and information processing technology have developed to a degree that voice synthesizing is available by using one or a few LSI (large scale integrated circuit) chips. Such LSI chips can produce synthesized voices for a few minutes, and besides their costs have been lowered so that their use has become practical for several kinds of home appliances.

SUMMARY OF THE INVENTION

The present invention provides a heating apparatus such as microwave ovens equipped with a voice synthesizing circuit for easy operations with the help of the synthesized voices produced in the heating apparatus. The heating apparatus embodying the present invention can largely avert the conventional maloperation problems.

The heating apparatus embodying the present invention can perform the folowing features.

(1) Key input data can be confirmed by the synthesized voices when the operation buttons are pushed or tapped in predetermined appropriate orders;

(2) First key input can be confirmed by the synthesized voices when the operation buttons are successively tapped, and following key input can be confirmed only by the synthesized beep sounds;

(3) When operation keys are pushed, the corresponding input data can be confirmed by the corresponding synthesized voices, and at this moment key inputs other than from the reset key are not processed by a main control circuit;

(4) Key input operations can be confirmed by any combination of the synthesized voices and the beep sounds;

(5) When the user erroneously starts the heating operation by placing a meat probe inside the heating chamber, he is warned by the corresponding instruction voices thereby averting maloperations;

(6) A built-in sound circuit is provided with a volume control means and is less sensitive to the noises; and (7) A much stabilized power source is employed for the digital signal circuits such as the main control circuit including the MPU and the voice synthesizing circuit, thus the heating operations are not affected even when the voltage from a power source for a speaker driving circuit is affected by driving a speaker.

BRIEF DESCRIPTION OF THE DRAWINGS

FIG. 4(*b*) is a circuit diagram of another power source circuit and a ripple damping circuit used in the heating apparatus embodying the present invention.

FIG. 4(*c*) is a circuit diagram of a display apparatus circuit used in the heating apparatus embodying the present invention.

FIG. 4(*d*) is a circuit diagram of a sensor-control circuit used in the heating apparatus embodying the present invention.

FIG. 4(*e*) is a circuit diagram of a voice synthesizing circuit used in the heating apparatus embodying the present invention.

DETAILED DESCRIPTION OF THE PREFERRED EMBODIMENTS

The present invention provides a heating apparatus comprising an enclosure case having therein a heating chamber in which a heating object is to be placed, the enclosure case having a door at an opening of the heating chamber, a heating means for generating heating energy in the heating chamber, a plurality of operation buttons interconnected with a key input means for inputting predetermined heating sequence data, a memory means for storing synthesizing voice data corresponding to predetermined heating sequence data, a voice synthesizing circuit for producing synthesized voices by the synthesizing voice data stored in the memory means following predetermined orders, and a control circuit means for controlling a heating operation of the heating means following predetermined sequence orders when heating sequence data are given thereto through the key input means.

Figure 1:
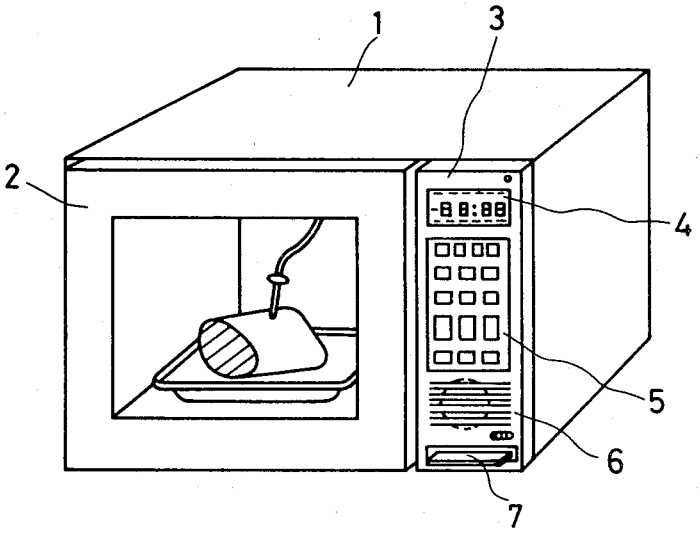
FIG. 1 is a perspective view of a heating apparatus embodying the present invention.

FIG. 1 is a perspective view of a heating apparatus embodying the present invention. A microwave oven case 1 comprises a door 2, which is hinged in front thereof and has a transparent window, through which foods placed inside a heating chamber can be seen. An operation panel 3 is provided at and attached to the front face of the heating apparatus case 1. The operation panel 3 is provided with a display part 4 used for displaying numerical data and several cooking modes. The operation panel 3 is further provided with a key board 5 for setting heating sequence programs and with a speaker 6 in the rear of the operation panel 3. The door 2 is provided with a lever 7 for opening it.

Figure 2:
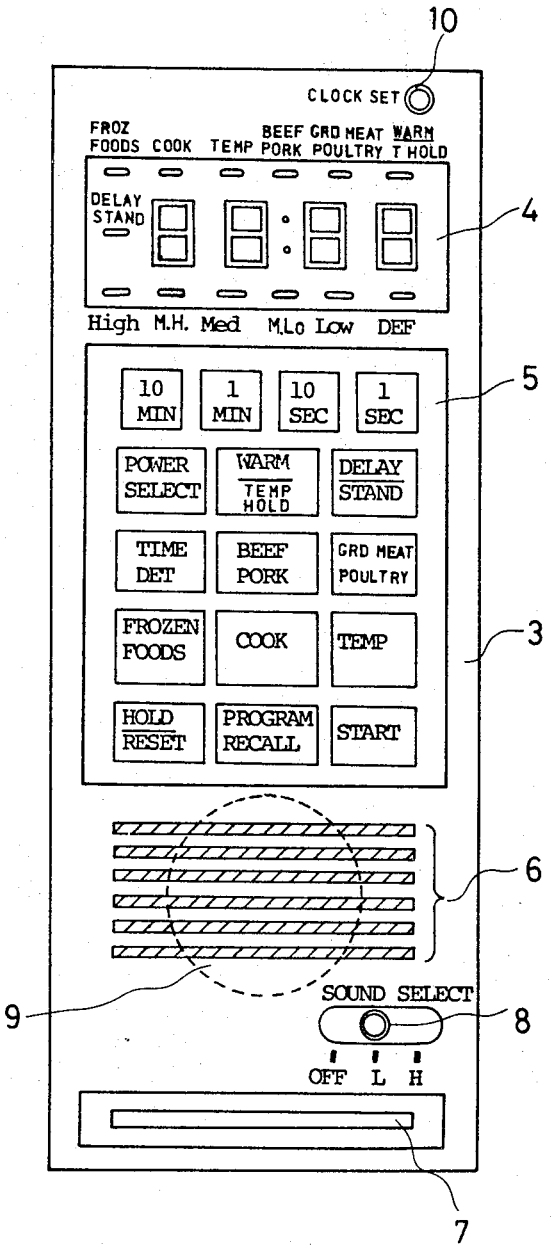
FIG. 2 is a front view of an operation panel of the heating apparatus of FIG. 1.

FIG. 2 is an enlarged front view of the operation panel 3 of the heating apparatus of FIG. 1. The display part 4 comprises a numeric display means for displaying figures of four digits each with 7-display-segments, a colon display means, and a status display means for displaying program status corresponding to key input data. The key board 5 is provided with 16 keys including several setting keys to input such sequence programs as shown in FIG. 2, and a reset key to cancel their input data. The operation panel 3 is further provided with a timer setting key 10 and a second level select knob 8 used for changing sound level of the synthesized voice from the heating apparatus embodying the present invention. A plurality of opening slots 6 are formed for a speaker 9 disposed on the rear side of the operation panel 3.

Figure 3:
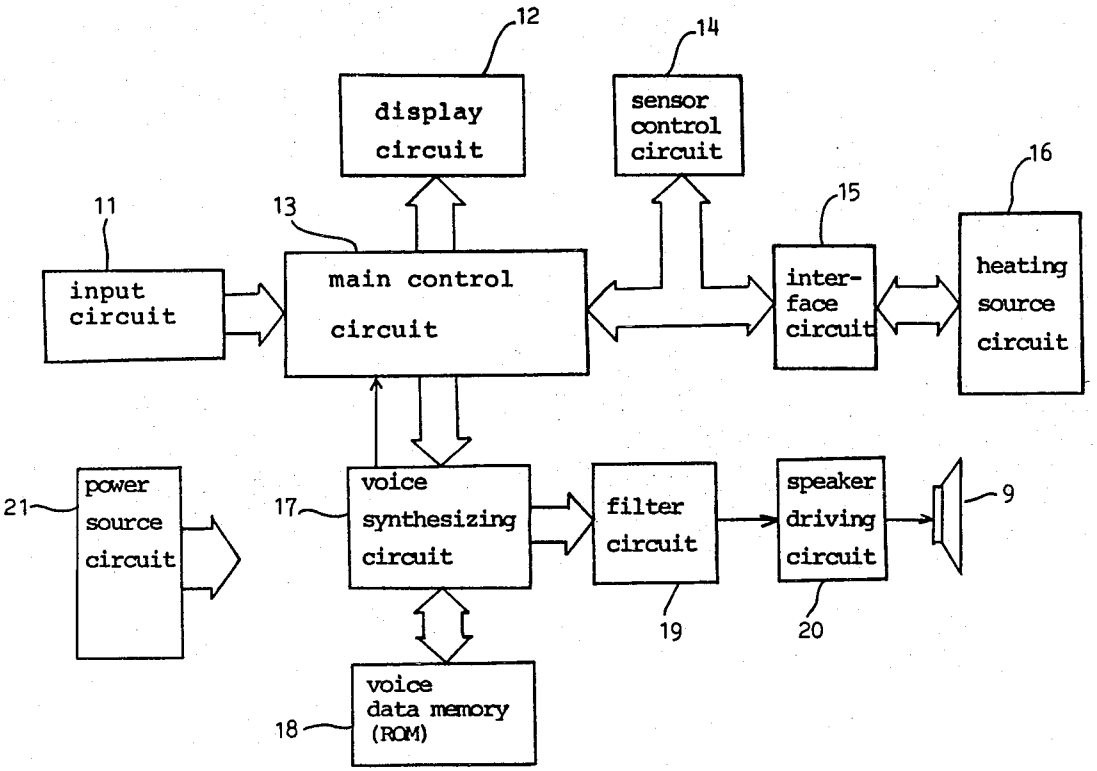
FIG. 3 is a block diagram of whole control circuits used in the heating apparatus embodying the present invention.
Figure 4A:
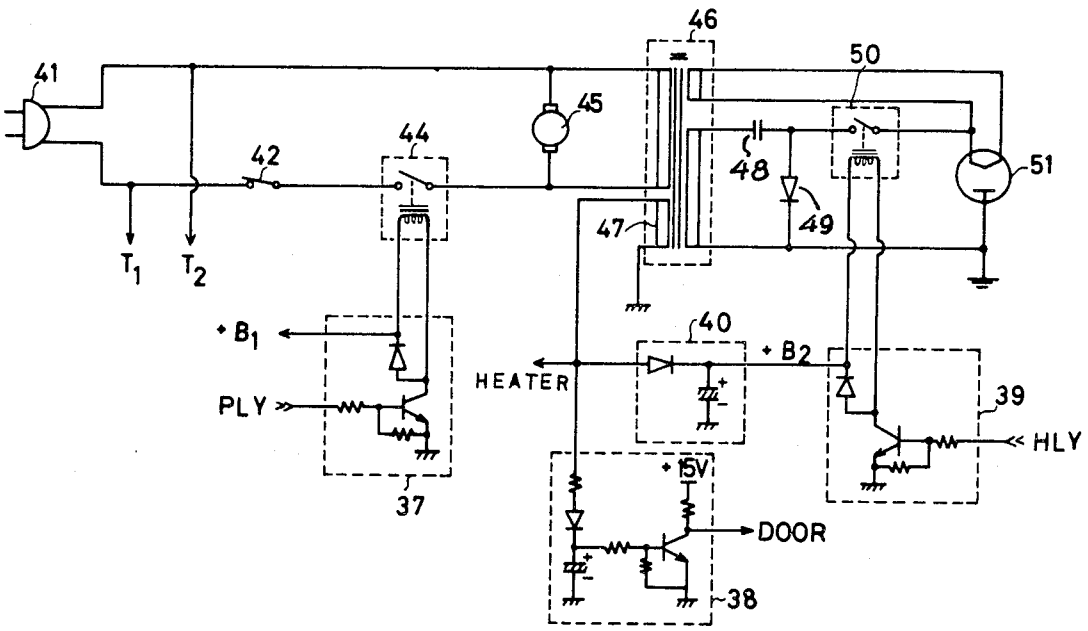
FIG. 4(*a*) is a circuit diagram of a power source circuit and a heating source used in the heating apparatus embodying the present invention.
Figure 4B:
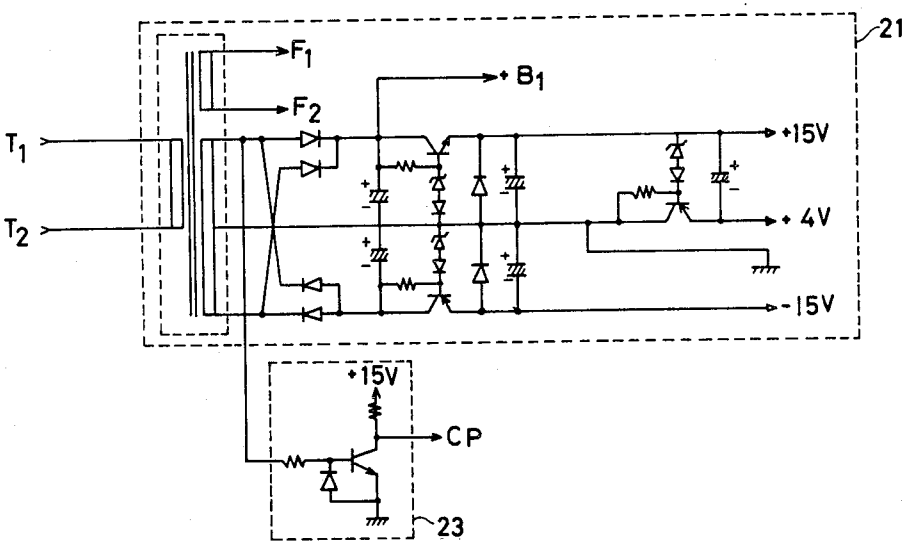
Figure 4C:
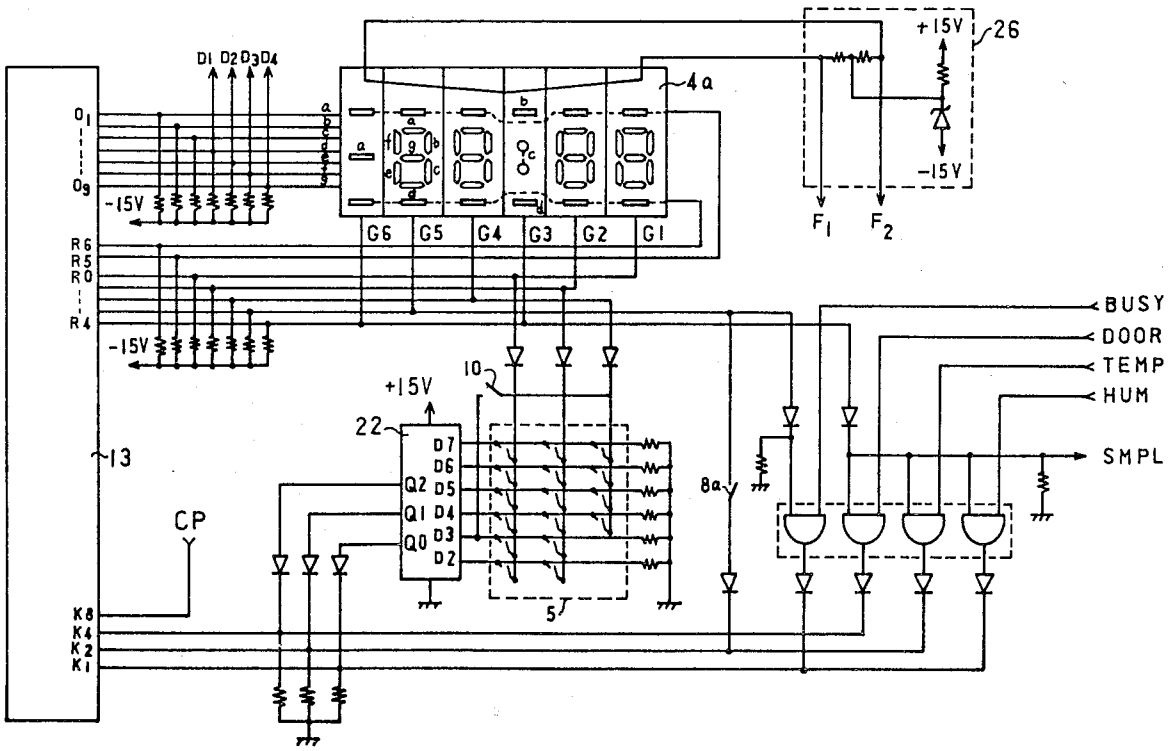
Figure 4D:
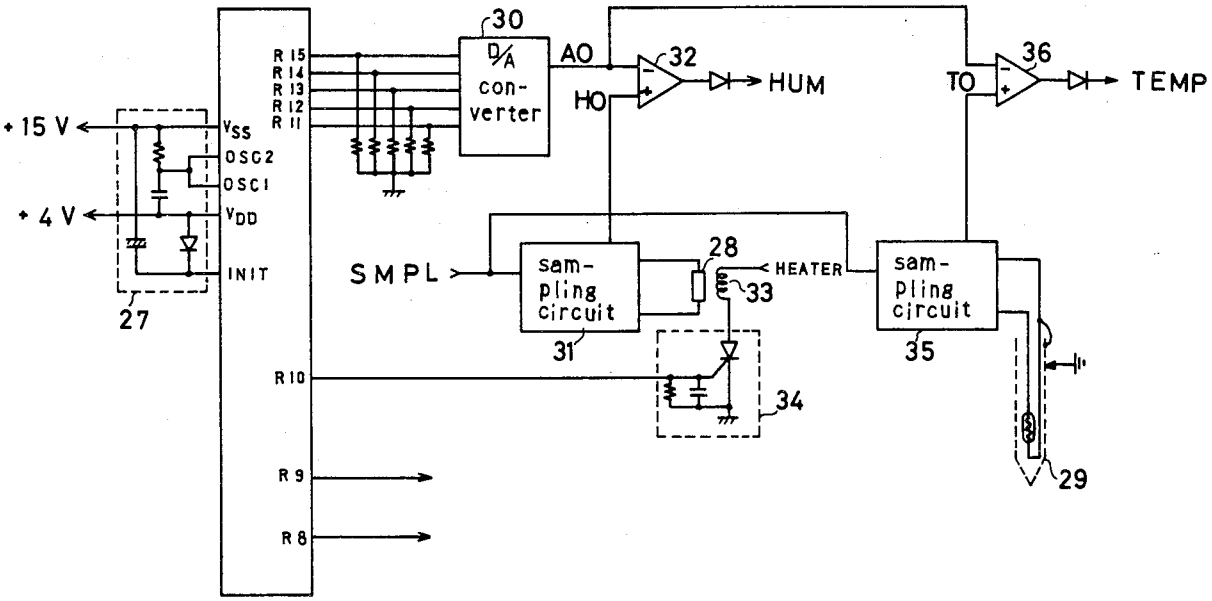
Figure 4E:
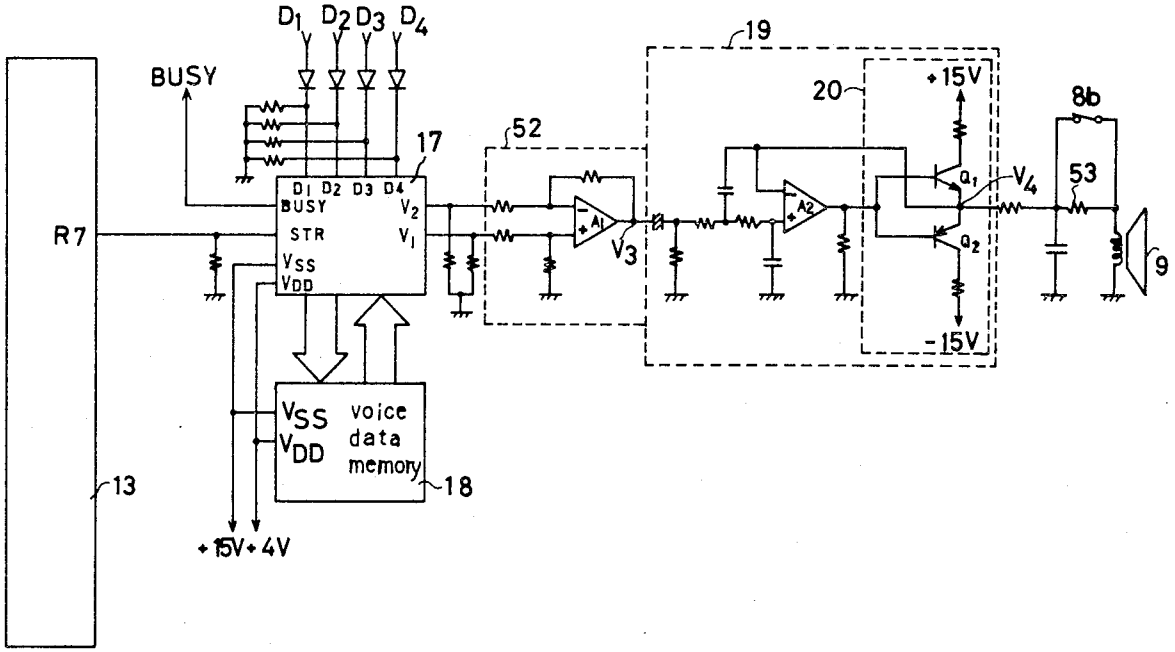

FIG. 3 is a block diagram of whole control circuits used in the heating apparatus embodying the present invention. An input circuit 11 is constituted by the key board 5 and the reset button 10 shown in FIG. 2. A display circuit 12 is used for controlling display states by the display part 4. A main control circuit 13 electrically controlls all circuit operations by an MPU (microprocessing unit) contained therein. A sensor-control circuit 14 controls a sensor operation for detecting heating states of the heating foods. An interface circuit 15 is used to send control signals from the main control circuit 13 is a heating source circuit 16. The whole circuits of FIG. 3 further comprises a voice synthesizing circuit 17, a voice data memory 18, a filter circuit 19, a speaker driving circuit 20 for driving a speaker 9, and a power source circuit 21.

In the embodyment of the present invention a microprocessing unit (MPU) of TMS-1670 produced by Texas Instruments Inc. is employed for the main control circuit 13. The operations of the MPU are known and hence not described here. TMS-1670 chip comprises a ROM (read only memory) of 4K bytes, a RAM (random access memory) of 512 bits, eight input port lines, sixteen individually-settable output port lines, eight parallel-settable output port lines, an ALU (arithmetic logic unit), an instruction PLA (programmable logic array), a program counter, a clock generator, an output PLA (programmable logic array), and several registers. The MPU carries out logic operations under the control of control programs stored in the 4K bytes ROM, and control operations are determined by conditions of input signals given to its input port lines.

FIG. 4(*a*) is a circuit diagram of a power supply circuit and a heating source used in the heating apparatus embodying the present invention. The circuit part corresponding to the power source circuit 21 in FIG. 3 comprises a plug 41 used for establishing electric supply from a commercial power source line, a door switch 42 interlocked with the user's opening and closing operations of the door 2, a power relay 44, a fan motor 45 for cooling, and a high tension transformer 46. The circuit part corresponding to the heating source circuit 16 comprises a high tension capacitor 48, a high tension diode 49, a high tension relay 50, and a magnetron 51.

A power relay driving circuit 37 energizes the power relay 44 by a PLY signal from the main control circuit 13 when the heating operation is started. A door-opening-state detection circuit 38 detects the opening and closing states of the door 2 when the power relay 44 is energized. An output signal "DOOR", which indicates that the door is now open, is issued from the door-opening-state detection circuit 38, upon it turning its signal level from H(high level) to L(low level), when an electric motive force is generated from a winding 47 of the high tension transformer 46 to the door-opening-state detection circuit 38. A high tension relay driving circuit 39 is used for controlling high frequency power output following a duty cycle determined by heating operation programs which can be set by pushing operation keys. A high tension relay driving circuit 40 sends an electric power from the winding 47 of the high tension transformer 46 to energize a high tension relay 50.

FIG. 4(*b*) is a circuit diagram of another power source circuit 21 and a ripple damping circuit 23 used in the heating apparatus embodying the present invention. Lines with symbols $F_1$ and $F_2$ are connected to filaments of luminescent display tubes in the display circuit 12 disposed at a display board 4*a* (shown in FIG. 4(*c*)). A line with symbol $+B_1$ supplies an unstabilized power voltage for driving the power relay 44. A stabilized voltage across lines with symbols +15 V and GND is supplied to peripheral digital circuits accompanied with the main control circuit 13 including an MPU. A further stabilized voltage across lines with symbols +15 V and +4 V obtained by further stabilizing the stabilized voltage across the lines with symbols +15 V and GND, is supplied to the main control circuit 13, a voice synthesizing circuit 17 and a voice data memory 18 (shown in FIG. 4(*e*)). A voltage across lines with symbols +15 V and −15 V is supplied to the sensor control circuit 14, the filter circuit 19, the speaker driving circuit 20 and the fluorescent display tubes of the display circuit 12. An output signal CP from the ripple damping circuit 23 is supplied to an input port terminal K8 of the main control circuit 13 for a time base of a timer.

FIG. 4(*c*) is a circuit diagram corresponding to the input circuit 11 and the display apparatus circuit 12 shown in FIG. 3 and used in the heating apparatus embodying the present invention. Input signals from the input keys disposed on the key board 5 and the reset key 10 are encoded by an encoder 22 synchronized with scanning signals issued from output port terminals R0, R1, and R2 of the main control circuit 13, and then are sent to input port terminals K1, K2 and K4 of the main control circuit 13. A switch 8*a* is used to control sound generation. When the switch 8*a* is closed, the scanning signal from the output port terminal R3 is sent to the input port terminal K2.

Signals "BUSY", "DOOR", "TEMP" and "HUM" as shown at lines with corresponding symbols on FIG. 4(*c*) are sent to input port terminals K1, K2 and K4, with timings synchronized with the scanning signals from output port terminals R3 and R4. A circuit 26 is a filament circuit for the fluorescent display tubes 4*a*. The fluorescent display tubes 4*a* comprises 6 grid electrodes G1 to G6 corresponding to four figures (G1, G2, G4 and G5). The display tubes 4*a* dynamically light up under a control of the scanning signals from the output port terminals R0 to R4. The scanning signal from the output port terminal R4 is applied to both grid electrodes G3 and G6.

FIG. 4(*d*) is a circuit diagram of a sensor-control circuit 14 used in the heating apparatus embodying the present invention. A humidity sensor 28 is used for detecting moisture from heating foods. A temperature sensor 29 called meat probe is used for detecting the temperature inside the foods by sticking the probe into them before starting the heating operation.

The sensor-control circuit 14 further comprises a sampling circuit 31 for sampling humidity levels, a sampling circuit 35 for sampling temperature levels, comparators 32 and 36 constituting a simplified D/A conversion system circuit together with a 5-bit D/A converter 30, and a driving circuit 34 used for a heater 33 of the humidity sensor 28, and a circuit 27 including an oscillation circuit and an initial reset circuit for the main control circuit 13. The heater 33 is power-supplied from the winding 47 of the high tension transformer 46 (shown in FIG. 4(*a*)).

The temperature sensor 29 can be disposed in or removed from the heating chamber. The temperature levels are detected by the D/A conversion system circuit, and thereby it is automatically checked by the main control circuit 13 whether the temperature sensor 29 is used in the heating chamber. This checking is made by a fact that a sufficiently low temperature level is detected when the temperature sensor 29 is removed.

FIG. 4(*e*) is a circuit diagram of a voice synthesizing circuit used in the heating apparatus embodying the present invention. Data signals are sent from the main control circuit 13 to the voice synthesizing circuit 17 through data signal lines with symbols D1 to D4. A syncronization signal "STR" from an output port terminal R7 of the main control circuit 13 is sent to the voice synthesizing circuit 17 when the voice synthesizing operation is instructed. When the voice synthesizing circuit 17 is in operation, i.e. when it produces synthesized voices, a BUSY signal is issued from the voice synthesizing circuit 17. Once the voice synthesizing circuit 17 is instructed to be set in operation, it reads necessary voice synthesizing data from a voice data memory 18, and issues a step-shaped synthesized voice signal corresponding to the taken-out data from output terminals $V_1$ and $V_2$ of the voice synthesizing circuit 17.

Circuits shown in FIG. 4(*e*) further comprises a differential amplifier circuit 52, a filter circuit 19 and a speaker driving circuit 20. The filter circuit 19 and the speaker driving circuit 20 constitutes a filter-drive system circuit wherein a power booster consisting of a pair of transistors Q1 and Q2 is connected to an output terminal of an operational amplifier $A_2$ in the filter circuit 19 and output signals of the power booster is fed back to an input terminal of the operational amplifier $A_2$. A switch 8*b* is used to connect or disconnect a resistor 53 to a speaker 9 in series thereby changing volume of the synthesized voice.

Figure 5:
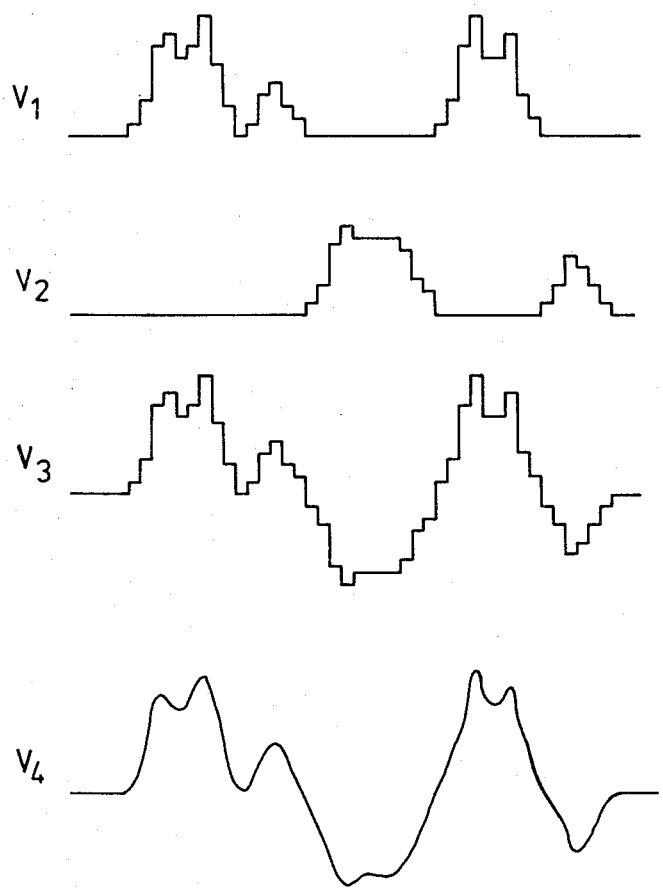
FIG. 5 is a graph showing waveforms of several parts of the voice synthesizing circuit used in the heating apparatus embodying the present invention.

FIG. 5 is a graph showing waveforms of several parts of the voice synthesizing circuit 17 shown in FIG. 4(*e*). Signal waveforms $V_1$ and $V_2$ correspond to synthesized voice signals coming out from the voice synthesizing circuit 17. A signal waveform $V_3$ corresponds to an output signal of the differential amplifier 52. A signal waveform $V_4$ corresponds to an output signal of the speaker driving circuit 20.

The ROM in the main control circuit 13, i.e. MPU chip stores the following control programs used for the heating apparatus embodying the present invention.

(i) Key input processing program, by which key input is detected, then it is checked whether the key input is appropriate at the input time before, during, or after the heating operation, and following the check the key input data is processed if it is appropriate;

(ii) A tapping number counting program for counting how many times the same input keys are tapped (when the same input keys are successively tapped, input data are successively renewed), and for checking which input keys are tapped in which orders;

(iii) A checking program for checking the use of the temperature sensor, i.e. meat probe by detecting the temperature signal level;

(iv) A memory control program for storing key input data;

(v) a count-down timer program for successively carrying out heat sequence programs corresponding to key input data;

(vi) A control program for controlling the display circuit;

(vii) A sensor-control program for controlling the sensor circuit;

(viii) A control program for controlling the function of the voice synthesizing circuit; and (iv) A timer program for producing a time base for heating sequence periods.

The heating apparatus embodying the present invention is provided with the MPU with the above-outlined control programs stored in its ROM areas.

The functions of each key on the key board 5 are explained below. Four keys of "10 MIN", "1 MIN", "10 SEC" and "1 SEC" are time setting keys for setting time length and timings for timer for constituting the heating sequence. These four numeral keys respectively correspond to respective figures of numeral indicator in the display part 4, and setting times of each figure are increased by the same indicated time length, namely is doubled, triplicated and so on by each additional tapping of these keys. A "POWER SELECT" key is for selecting the microwave output power levels, and five different power levels, for example, can be selected by tapping this key. A "WARM/TEMP HOLD" key is for setting a "WARM" function, which is for heating the heating object for a preset time period by a power level suitable for WARM program when operating the apparatus without the temperature sensor, i.e. meat probe, and for setting a "TEMP HOLD" function, which is for moderately heating the heating object for a preset time period keeping a preset temperature by utilizing a detection signal of the temperature sensor (meat probe) inserted in the food to detect the temperature. The "DELAY/STAND" key is for setting a "DELAY" function, which is for prolonging the heating even after the preset period come to its end, by pushing it before the starting of the heating sequence, and for setting a "STAND" function, which is for leaving the heating object without heating for a preset time period after the heating sequence, by pushing it after the heating sequence operation. A "TIME DEF" key is used for defrosting an ordinary frozen food and is for setting a function which is to heat the heating object for a preset period at a power level corresponding to defrosting program, and then to leave it for the same time period thereafter. "BEEF PORK" key and "GRD. MEAT POULTRY" key are used for defrosting the respective frozen foods. A "FROZEN FOODS" key is for setting an automatic heating which is to cook the frozen food by means of a control system using a humidity sensor, and various kinds of cooking can be selected by sequential tapping of this key. A "COOK" key is for setting another kind of automatic heating which is to cook food of a room temperature by means of the control system using the humidity sensor, and various kinds of cooking can be selected by tapping this key. A "TEMP" key is used for automatic heating by means of a temperature control of foods using a temperature sensor (meat probe), and various kinds of cooking can be selected by tapping this key. A "HOLD/RESET" key is for setting a "HOLD" function which stops the operation of the heating source 16 when it is in operation, and is for setting a "RESET" function which resets the stored program when it is out of operation. A "PROGRAM RECALL" key is used for recalling and confirming the stored program of heating sequence. And a "START" key is for starting the heating operation of the heating source 16 by the preset heating sequence.

The operation of this embodiment is explained below. At first, in the present invention, a control program is preliminarily stored in a manner that a key input is judged whether it is available or not, and then a voice corresponding to the key input is synthesized only when the input is available. For example, the "POWER SELECT", "DELAY/STAND" and "TIME DEF" keys are function keys for setting heating sequence by time control, and therefore time setting by four numeral keys is necessarily required as a proceeding procedure for setting heating sequence. At this time, if the user pushes any keys except the time setting keys or the "RESET" key, the microprocessor 13 detects the input as being inappropriate and does not feed a control signal for synthesizing the corresponding voice to the voice synthesizer 17. Unless the apparatus includes such measure, voices are produced whenever any of the keys are pushed and it may cause program error of the heating sequence.

Furthermore, in the present invention, the keying input is not input into the circuit of the apparatus during voice synthesizing by the control program. Unless the apparatus includes such measure, keying input operation may sometimes interrupts a voice synthesizing and produce another newly synthesized voice which takes over interrupting the former voice, and the voice lose appropriate meaning, and it may cause a maloperations. However, the information by the "HOLD/RESET" key can be input whenever the key is pushed, because this key should be used even at an emergency.

The "POWER SELECT", "FROZEN FOODS", "COOK" and "TEMP" keys have a function to be switched by tappings, and the contents of inputting are sequentially changed by tapping the keys. As shown in the following list, at a first tapping input, a beep sound "Pi" is produced and follows a synthesized voice corresponding to the respective keys in order to inform the inputting data from the respective keys to the user. And after the second tapping, only a single beep sound is produced without repeating synthesized voice for every tapping operation, thereby enabling quick tapping operation. If the same voices as that of the first tapping are repeatedly produced for every tapping, the tapping operation becomes very slow in order to wait every ending of the voices and takes much time to set the desired heating sequence when the sequence requires sequential tapping.

| name of key | produced voice at first tapping | produced voice after second tapping |
|---|---|---|
| POWER SELECT | Pi Select cooking time | Pi |
| FROZEN FOODS | Pi Cover foods | Pi |
| COOK | Pi Cover foods | Pi |
| TEMP | Pi Insert probe | Pi |

In the present invention, distinction is made between the first tapping or the second tapping and thereafter from each other and respective voice and beep sound are synthesized in the voice synthesizer 17 with respect to the number of tapping.

In case the heating sequence with detecting the temperature of the food by the meat probe 29 is set by the "TEMP" key etc., the meat probe must be provided in the heating chamber. On the contrary, when the heating sequence without the meat probe is selected, the meat probe 29 must be removed from the heating chamber in order to protect it from exposure to the microwave radiation. Therefore, in the present invention, a measure for detection that the meat probe is set in the chamber is provided for protecting the meat probe. That is, when the user pushes a key for the sequence of setting a heating without use of the meat probe, such as "COOK" key with leaving the meat probe 29 set in the chamber, the apparatus produces a voice "Remove probe." in order to call the user's attention to remove it. On the contrary, when, under the condition that the meat probe is removed, the user pushes the "TEMP" key for setting the heating sequence which necessitates the meat probe, the apparatus produces "Insert probe." in order to call the user's attention. By means of the abovementioned measures the users correctly use the heating sequence by the abovementioned voice information. But once she becomes well skilled in the use of the heating apparatus, such voice informations are no more necessary to him or her and further, such may become even offensive to him or her. Therefore, in the present invention, only the beep sound "Pi" can also be produced without synthesizing the voice by the "Voice-off" switch 8*a*.

Furthermore, in the present invention, a volume adjusting means consisting of the volume adjusting switch 8 and the resistor 53 is provided across the speaker driving circuit 20 and the speaker 9, that is in the last stage of the electric circuit, so that the voice information is not much influenced by internal electric noises peculiar to the microwave oven. Generally speaking, there are high intensity electric noises radiated from the magnetron inside the heating chamber, and accordingly such noises may be mixed in the voice synthesizing circuit through a lead wire for the volume adjusting switch 8*b*. In the present invention, such mixed noises are effectively reduced by connecting the volume adjusting means at a very low impedance part at the last stage part, for example, the output terminal of the speaker driving circuit 20. Both the voice-off switch 8*a* and the volume adjusting switch 8*b* are interconnected to the voice selection knob 8, and these switches are connected with respect to the positions of the voice selection knob 8 as shown in the following table.

| position of the voice selection switch | "OFF" | "L" | "H" |
|---|---|---|---|
| voice off switch 8a is: | ON | OFF | OFF |
| volume switch 8b is: | OFF | ON | OFF |
| contents of information: | only beep sound | beep sound and voice | beep sound and voice |
| volume of voice | normal | small | normal |

Next, the construction concerning a power supply is mentioned below.

In the present invention, power supply is classified into two types, one of which is for the speaker driving circuit 20, wherein temporary lowering of the output voltage and temporary rising of ripple damping factor are allowed when driving the speaker, and the other is the power source for the data processing circuits such as the microprocessor 13, the voice synthesizer 17, and the ROM for voice data 18, which are very sensitive to voltage change and noises. In the present invention, the voltage to be impressed to the former circuit (speaker driving circuit) is selected higher than that of the latter one (data processing circuit), and the power of the latter is obtained from the output of the former one. Therefore, even when the output voltage of the former becomes somewhat lower or includes changing of the ripple damping factor when the speaker is driven, the latter voltage is kept accurately to the predetermined voltage. In addition, the power supply circuit is simplified and economical. This is advantageous over the conventional power source system where circuits of the former and the latter are separately structured.

What is claimed is:

1. A heating apparatus comprising an enclosure case having therein a heating chamber in which an object to be heated is to be placed, said enclosure case having a door at an opening of said heating chamber, a heating means for generating heating energy in said heating chamber, a plurality of operation buttons interconnected with a key input means for inputting predetermined heating sequence data, a voice data memory means for storing synthesizing voice data corresponding to predetermined heating sequence data, a voice synthesizing circuit for producing synthesized voice signals from said synthesizing voice data stored in said voice data memory means, a speaker for generating synthesized voices upon receipt of said synthesized voice signals from said voice synthesized circuit, and microcomputer control circuit means for controlling circuit operations of said voice synthesizing circuit, and controlling heating operations of said heating means following predetermined sequence orders when heating sequence data are given thereto through said key input means said microcomputer control circuit means comprising a built-in read only memory (ROM) for storing programs comprising a first algorithm for checking the validity of key input data and a second algorithm for actuating said voice synthesizing circuit only when said key input data are determined to be valid based on predetermined criteria.

2. A heating apparatus in accordance with claim 1, wherein said operation buttons are for inputting predetermined heating sequence data by tapping operations, said voice data memory means is further for storing beep sound data, said voice synthesizing circuit is further for producing beep sound signals corresponding to said beep sound data, and said microcomputer control circuit means further comprising a counting means for counting key tapping numbers.

3. A heating apparatus in accordance with claim 1, wherein said microcomputer control circuit means further comprises another a heating sequence memory means for storing heating sequence program orders set by said operation buttons, said operation buttons comprise reset key buttons, and said microcomputer control circuit means further comprises a checking means for receiving input signals only from said reset key buttons when said voice synthesizing circuit produces synthesized voices.

4. A heating apparatus in accordance with claim 1 further comprising a switch, wherein said voice data memory means comprises means for storing beep sound data, said voice synthesizing circuit comprises means for producing beep sound signal corresponding to said beep sound data, and said switch can be actuated to control said voice synthesizing circuit in such a manner that only a beep sound signal is produced in said voice synthesizing circuit and voice signals are inhibited.

5. A heating apparatus in accordance with claim 1 further comprising a temperature sensor for detecting a temperature inside said object being heated, wherein said microcomputer control circuit means further comprises a checking means for detecting a signal corresponding to necessary guiding instruction voices to be issued by said speaker, the voices having contents corresponding to the states of using said temperature sensor or the state not using said temperature sensor, in said heating chamber, and said voice synthesizing circuit comprises means for producing additional synthesized voice signals corresponding to said instruction voices.

6. A heating apparatus in accordance with claim 1 further comprising a filter circuit for filtering voice signals from the voice synthesizing circuit, a speaker driving circuit connected to an output terminal of said filter circuit, and a volume control means connected to an output terminal of said speaker driving circuit.

7. A heating apparatus in accordance with claim 6 further comprising a first power source circuit for powering the heating means, and a second power source circuit for powering said memory means, said voice synthesizing circuit and said control circuit means, said second power source circuit being connected to an output side of said first power source circuit.

8. A heating apparatus in accordance with claim 1 further comprising a first power source circuit for powering the heating means, and a second power source circuit for serving a second power source for said memory means, said voice synthesizing circuit and said control circuit means, said second power source circuit being connected to an output side of said first power source circuit.

9. In a microcomputer controlled heating apparatus wherein a heating sequence to be carried out by the apparatus is provided to the apparatus by a user via a set of input keys, the improvement comprising the combination therewith:

a key input checking program stored in the microcomputer for checking the appropriateness of key actuations according to predetermined criteria, and a voice synthesizer for synthesizing a voice command to the user, the absence of a voice command or the presence of a particular voice command (a) indicating the appropriateness or inappropriateness of a particular key actuation or sequence of key actuations, or (b) providing a status instruction to the user.

10. An improvement according to claim 9 wherein the voice synthesizer includes means for synthesizing a non-voice sound in addition to a voice command, the sound being used to communicate to the user.

11. An improvement according to claim 9 wherein the heating apparatus includes a removable temperature probe and a means for sensing the presence of the temperature probe within the heating chamber and wherein the key input checking program, sensing means and synthesizer together operate to (a) instruct the user to remove the probe if a heating sequence is entered via the input keys that does not require use of the probe and the probe is within the chamber, and (b) instruct the user to insert the probe into an object being heated if a heating sequence is entered via the input keys that requires use of the probe and the probe is not within the chamber.

12. A heating apparatus, comprising:

a heating chamber adapted to receive an object to be heated;

heating means for generating heating energy within the chamber;

data input keys for programming the apparatus to execute a heating sequence;

a temperature probe insertable into and removable from the heating chamber for sensing the temperature of an object being heated;

means for sensing the presence of the probe within the chamber;

a voice synthesizer for generating voice commands and sound signals indicative of a status of the apparatus; and microcomputer control circuit means for controlling the programming of the apparatus to a cooking sequence defined by data entered by the user via the data input keys and the execution of a cooking sequence so entered, the microcomputer including algorithms for controlling the apparatus (a) to confirm input data entered via the data input keys with voice commands and/or sound signals, (b) to exclude the entry of data via the data input keys under certain predetermined conditions (c) instruct the user to remove the probe if a cooking sequence is entered via the input keys that does not require use of the probe and the probe is within the chamber, (d) instruct the user to insert the probe into a food being cooked if a heating sequence is entered via the input keys that requires use of the probe and the probe is not within the chamber; and (e) to count the number of sequential tappings of a data key so that information can be programmed responsive to the identity of the keys and number of times the keys are tapped.

13. A heating apparatus according to claim 12 wherein the algorithm for confirming input data is structured so as to confirm an initial tapping of a data input key with a responsive synthesized voice command and with a sound signal and to confirm second and subsequent sequential tappings of the same key with only a sound signal.

14. A heating apparatus according to claim 12 further including a humidity sensor disposed within the heating chamber, and wherein the microcomputer includes an algorithm for executing a heating sequence that is at least in part a function of humidity in the chamber, providing an indication of moisture being driven off of an object being heated.

* * * * *